US011103757B2

(12) United States Patent
Lyons

(10) Patent No.: US 11,103,757 B2
(45) Date of Patent: Aug. 31, 2021

(54) PORTABLE CURLING-BROOM

(71) Applicant: Rose-Ann Kathleen Lyons, Kelowna (CA)

(72) Inventor: Rose-Ann Kathleen Lyons, Kelowna (CA)

( * ) Notice: Subject to any disclaimer, the term of this patent is extended or adjusted under 35 U.S.C. 154(b) by 188 days.

(21) Appl. No.: 15/812,624

(22) Filed: Nov. 14, 2017

(65) Prior Publication Data

US 2019/0143187 A1 May 16, 2019

(51) Int. Cl.

| | |
|---|---|
| ***B25G 1/04*** | (2006.01) |
| ***A63B 67/14*** | (2006.01) |
| ***B25G 1/10*** | (2006.01) |

(52) U.S. Cl.

CPC ..... *A63B 67/148* (2013.01); *B25G 1/04* (2013.01); *B25G 1/102* (2013.01)

(58) Field of Classification Search

CPC ..... A63B 67/14; B25G 1/04; A47L 13/52

See application file for complete search history.

(56) References Cited

U.S. PATENT DOCUMENTS

| | | | | |
|---|---|---|---|---|
| 1,541,674 | A | 11/1924 | Wever | |
| 3,913,164 | A | 10/1975 | Semenchuk | |
| 7,264,556 | B1 | 9/2007 | Divisconti | |
| 7,356,871 | B2 * | 4/2008 | Heaven | B25G 1/04 15/143.1 |
| 2006/0200924 | A1 * | 9/2006 | Hampton | A46B 5/0033 15/144.3 |
| 2007/0087855 | A1 | 4/2007 | Barrera et al. | |
| 2017/0240143 | A1 * | 8/2017 | Vaeth | B60S 3/045 |

FOREIGN PATENT DOCUMENTS

| | | |
|---|---|---|
| CA | 2190667 | 5/1998 |
| CA | 2279025 | 1/2001 |
| CA | 2461382 | 8/2005 |
| CH | 667997 | 11/1988 |
| DE | 202011105437 | 3/2012 |
| GB | 2468851 | 9/2010 |

* cited by examiner

*Primary Examiner* — Michael D Jennings

(57) ABSTRACT

A portable curling-broom includes a handle having a first-end, a second-end, and an inner-volume. The handle includes a curling-broom head, and a first-section and a second-section being removably coupled. The portable curling-broom is useful for providing a curling-broom that may easily be transported when folded. A kit may be included.

17 Claims, 5 Drawing Sheets

PORTABLE CURLING-BROOM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of curling brooms and more specifically relates to a portable curling-broom.

2. DESCRIPTION OF RELATED ART

Curling is a sport in which players slide stones on a sheet of ice towards a target area which is segmented into four concentric circles. The sport is similar to shuffleboard. Curling requires the use of a curling broom. The curling broom, or brush, is used to sweep the ice surface in the path of the stone, and is also often used as a balancing aid during delivery of the stone. The curling broom is long and often hard to transport to and from curling games. Therefore, a suitable solution is desired.

U.S. Pat. No. 1,541,674 to Wever, Olga C. relates to a golf stick. The described golf stick includes a golf stick which may be folded when not in use to permit the same to be carried in a traveling bag or to be concealed within a golf bag. An object is to provide a golf stick in two sections, which sections are hingedly connected in a manner to withstand the strain when the stick is in use during the playing of the game of golf. A further object resides in the provision of a foldable golf stick which is simple in construction, cheap of manufacture and easy to fold or assemble.

BRIEF SUMMARY OF THE INVENTION

In view of the foregoing disadvantages inherent in the known curling broom art, the present disclosure provides a novel portable curling-broom. The general purpose of the present disclosure, which will be described subsequently in greater detail, is to provide a curling broom able to fold for purposes of transporting the curling broom conveniently.

A portable curling-broom is disclosed herein. The portable curling-broom includes a handle having a first-end, a second-end, and an inner-volume. A curling-broom head may be attached to the first-end. The handle may comprise a first-section and a second-section removably coupled at a middle of the first-end and the second-end, and configured to enable a connected-state and a disconnected-state. The inner-volume may include a rope to retain the first-section with the second-section when in the disconnected-state.

A method of using the portable curling-broom is also disclosed herein. The method of using the portable curling-broom may comprise the steps of: providing a portable curling-broom having a handle and an inner-volume including a rope; the handle comprising a first-section and a second-section removably coupled, and configured to enable a connected-state and a disconnected-state, pulling the second-section from the first-section to initiate the disconnected-state, and folding the first-section and the second-section.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a portable curling-broom, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a curling broom and more particularly to a portable curling-broom as used to improve transportability of the 'portable' curling-broom.

Generally, the portable curling-broom may fold down to half of its full size for improving transportation of curling brooms. The curling-broom may be maintained together as one product. The portable curling-broom may make travel more convenient because it can always be carried with a user. The present disclosure reduces in size to be easier to carry and store. Further, the portable curling-broom includes materials for making it tough and durable.

Figure 1:
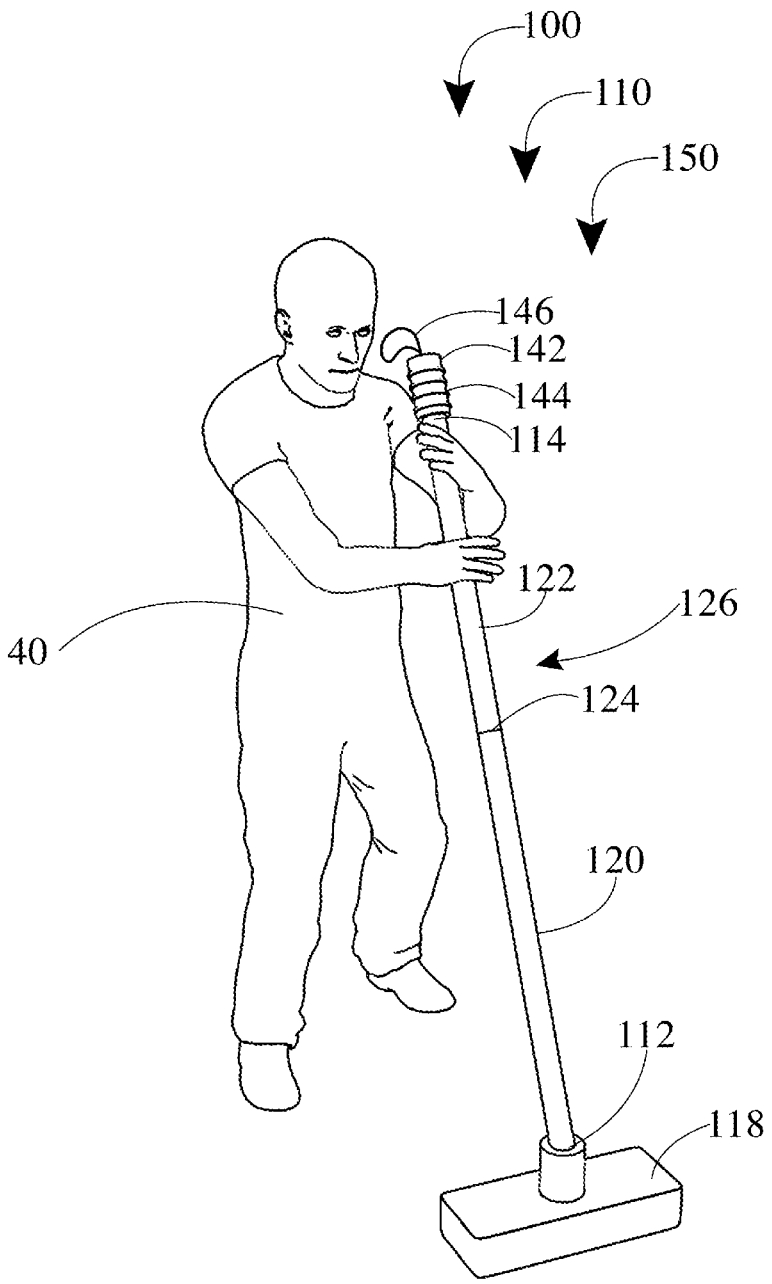
FIG. 1 is a perspective view of the portable curling-broom during an 'in-use' condition, according to an embodiment of the disclosure.

Referring now more specifically to the drawings by numerals of reference, there is shown in FIGS. 1-4, various views of a portable curling-broom 100. FIG. 1 shows the portable curling-broom 100 during an 'in-use' condition 150 by a user 40, according to an embodiment of the present disclosure. As illustrated, the portable curling-broom 100 may include a handle 110 having a first-end 112, a second-end 114, and an inner-volume 116. A curling-broom head 118 may be attached to the first-end 112. The curling-broom head 118 may be attached to the first-end 112 via a fastener being semi-pliant to forces caused by the user 40 during game-play. The handle 110 may comprise a first-section 120 and a second-section 122 removably coupled at a middle 124 of the first-end 112 and the second-end, 114 and configured to enable a connected-state 126 and a disconnected-state 128. The inner-volume 116 may include a rope 130 to retain the first-section 120 with the second-section 122 when in the disconnected-state 128. Disconnected-state 128 can refer to folded over or the like.

The portable curling-broom 100 may further include a hand-grip 142 at the second-end 114 of the handle 110. The hand-grip 142 may include a plurality of ridges 144 for an improved grasp of the user 40. The hand-grip 142 may be gripped by the user 40 during the 'in-use' condition 150. The second-end 114 may further include a carrying-strap 146 near the hand-grip 142.

The present disclosure may be advantageous in transporting the portable curling-broom 100. The handle 110 may be approximately 5 feet long when in the connected-state 126. However, the handle 110 may be approximately 2.5 feet long when in the disconnected-state 128 enabling the portable curling-broom 100 to be conveniently stored in a bag, suitcase, etc. Further, the handle 110 may include instructional-indicia (not shown) for instructing the user 40 on how to properly use the portable curling-broom 100 for transportation. Upon reading this specification, it should be appreciated that, under appropriate circumstances, considering such issues as user preferences, design preference, structural requirements, marketing preferences, cost, available materials, technological advances, etc., other arrangements such as, for example, length of the handle 110, telescopic means, etc., may be sufficient According to one embodiment, the portable curling-broom 100 may be arranged as a kit. The kit may include portable curling-broom 100. The instructions may detail functional relationships in relation to the structure of the portable curling-broom 100 (such that the portable curling-broom 100 can be used, maintained, or the like, in a preferred manner). A carrying case may also be included.

Figure 2:
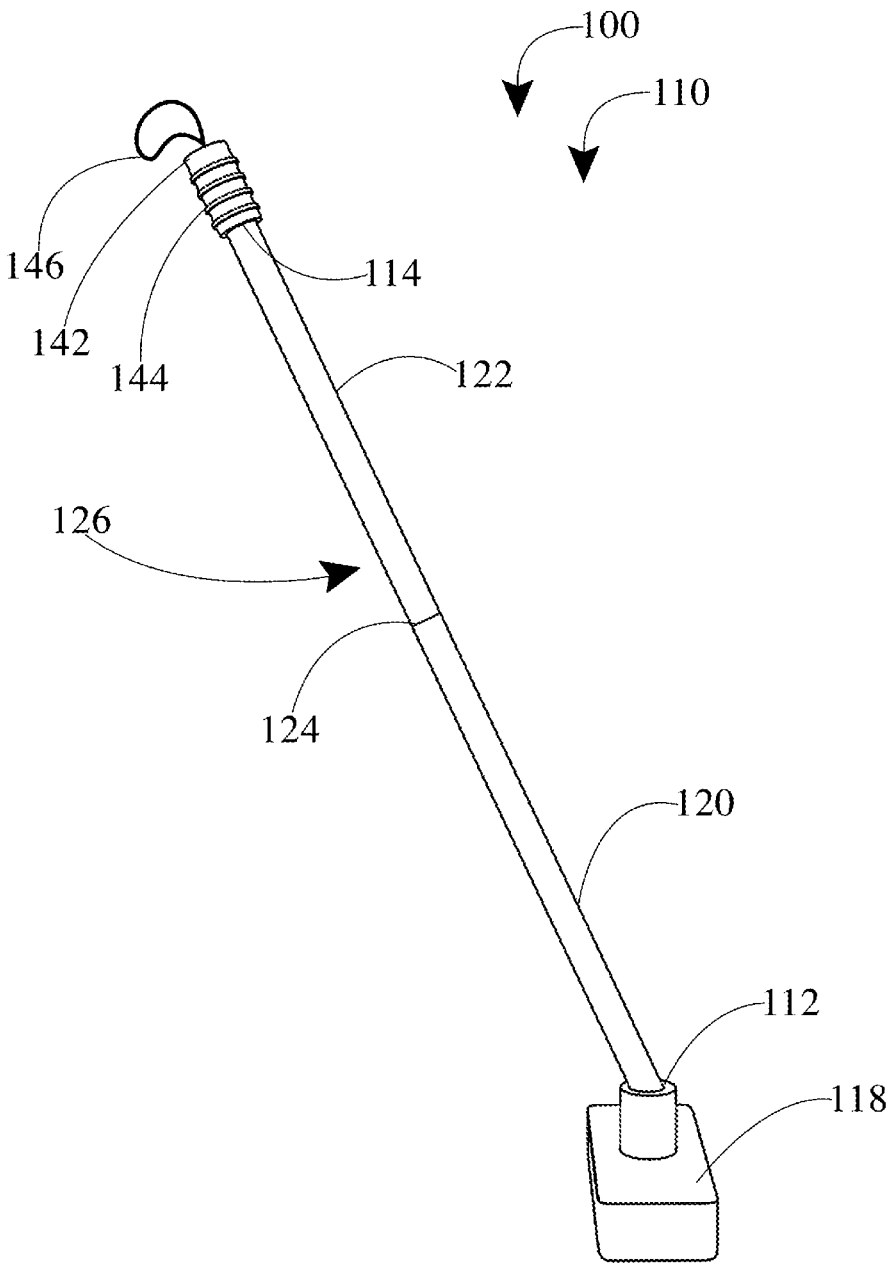
FIG. 2 is a side perspective view of the portable curling-broom of FIG. 1, according to an embodiment of the present disclosure.

Referring now to FIG. 2 showing a side perspective view of the portable curling-broom 100 of FIG. 1, according to an embodiment of the present disclosure. As above, the portable curling-broom 100 may include the handle 110 in the connected-state 126. The handle 110 may comprise of light-weight material for easier transportation. The light-weight material may include carbon fibers and/or glass fibers. In an alternative embodiment, the handle 110 may comprise of heavy-weight material.

Figure 3:
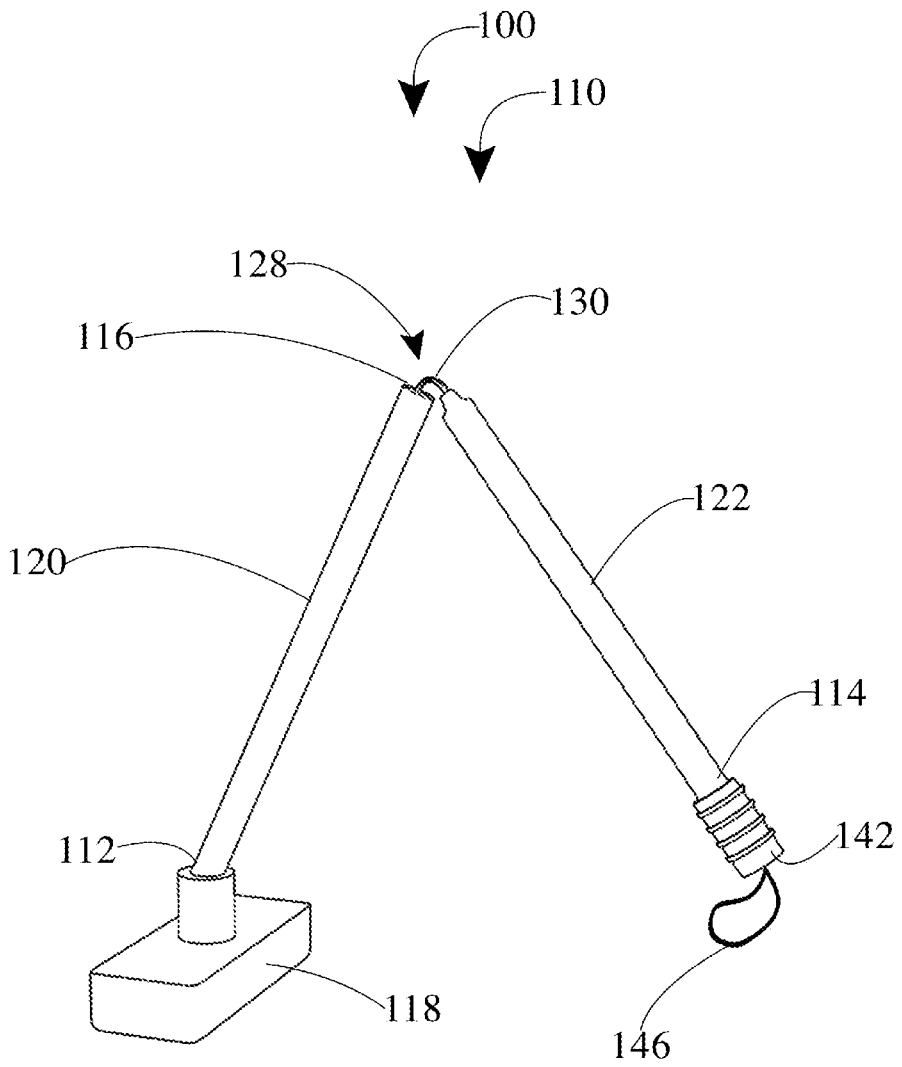
FIG. 3 is a perspective view of the portable curling-broom when in a disconnected-state of FIG. 1, according to an embodiment of the present disclosure.

FIG. 3 shows a perspective view of the portable curling-broom 100 of FIG. 1, according to an embodiment of the present disclosure. As above, the portable curling-broom 100 may include the handle 110 which includes the first-section 120 and the second-section 122 removably coupled at the middle 124 of the first-end 112 and the second-end 114, and configured to enable the connected-state 126 and the disconnected-state 128. The inner-volume 116 may include the rope 130 to retain the first-section 120 with the second-section 122 when in the disconnected-state 128. The rope 130 may be attached from the first-end 112 to the second-end 114 in the inner-volume 116. The rope 130 may comprise an elastomeric material to enable folding. Further, the rope 130 may include a thickness preventing splitting of the rope 130 after being used multiple times.

Figure 4:
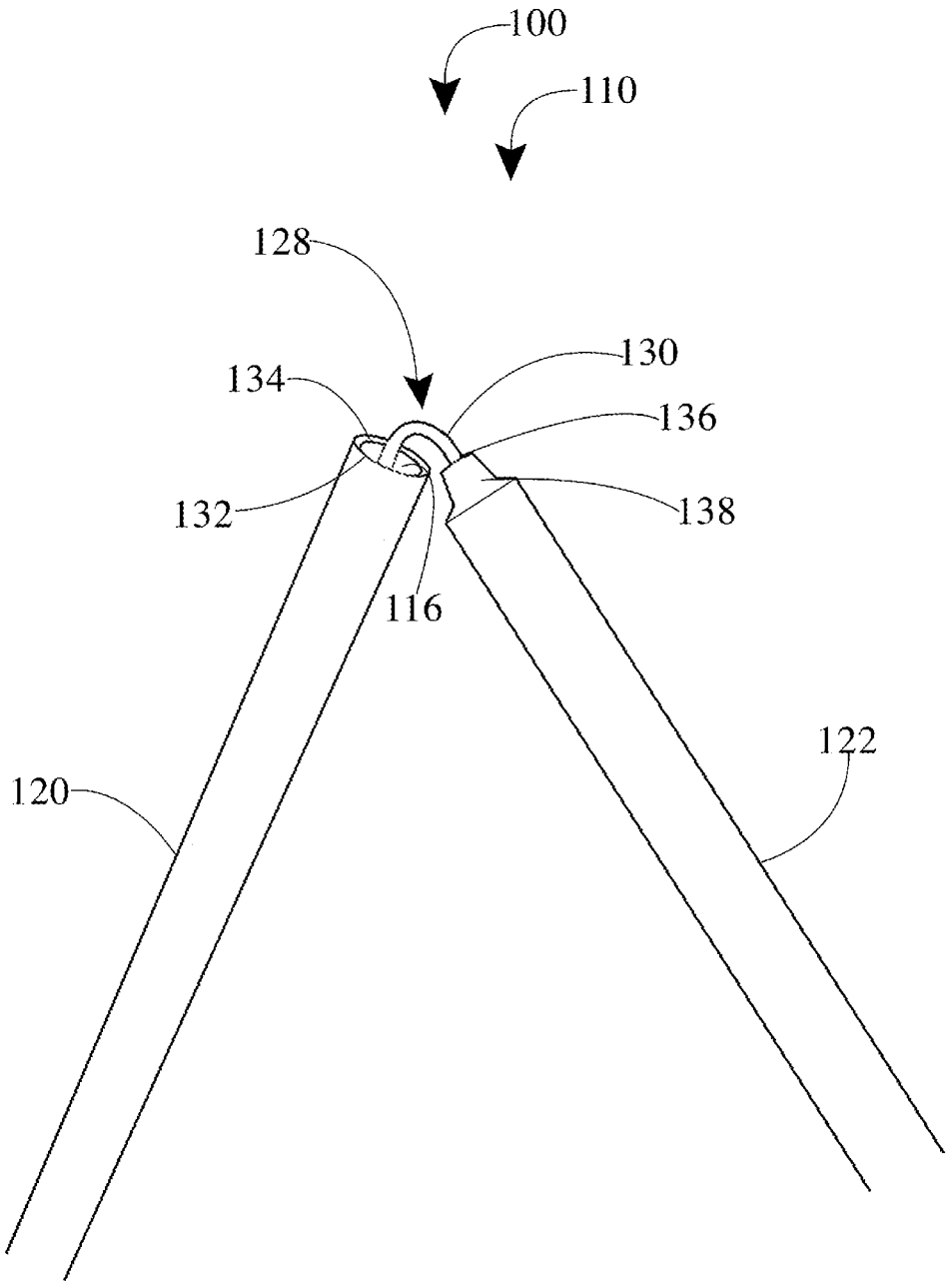
FIG. 4 is a perspective view of the disconnected-state of the portable curling-broom of FIG. 1, according to an embodiment of the present disclosure.

Referring now to FIG. 4 showing a perspective view of the portable curling-broom 100 of FIG. 1, according to an embodiment of the present disclosure. As above, the portable curling-broom 100 may include the handle 110 having the first-end 112, the second-end 114, and the inner-volume 116. The handle 110 may comprise the first-section 120 and the second-section 122 removably coupled at the middle 124 of the first-end 112 and the second-end 114, and configured to enable the connected-state 126 and the disconnected-state 128. The second-section 122 includes a second-section-end 138 having a second-diameter 136 being smaller than a first-diameter 134 on a first-section-end 132 of the first-section 120. The second-section-end 138 may be configured to be inserted into the first-section-end 132 when in the connected-state 126.

Figure 5:
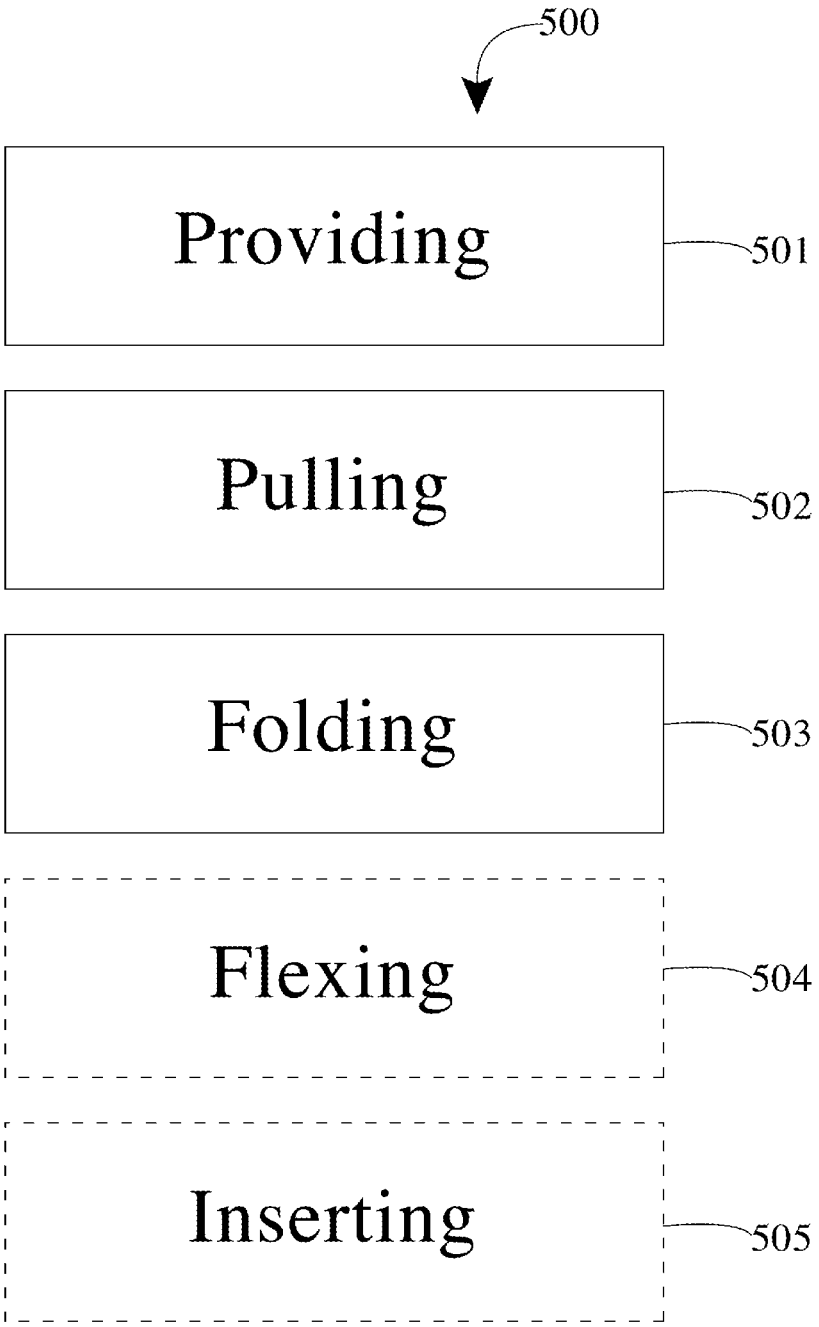
FIG. 5 is a flow diagram illustrating a method of using a portable curling-broom, according to an embodiment of the present disclosure.

FIG. 5 is a flow diagram 550 illustrating a method of using a portable curling-broom 500, according to an embodiment of the present disclosure. As illustrated, the method of using a portable curling-broom 500 may include the steps of: step one 501, providing a portable curling-broom having a handle and an inner-volume including a rope. The handle comprises a first-section and a second-section removably coupled, and configured to enable a connected-state and a disconnected-state; step two 502, pulling the second-section from the first-section to initiate the disconnected-state; step three 503, folding the first-section and the second-section; step four 504, flexing the first-section and the second-section to enable the connected-state; and step five 505, inserting the second-section in the first-section. The present invention may be transported and used as such.

It should be noted that steps 504 and 505 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the portable curling-broom 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A portable curling-broom, the portable curling-broom comprising:

a handle having a first-end, a second-end, and an inner-volume;

a curling-broom head attached to said first-end;

wherein a first-section and a second-section reversibly couple to each other to form a connected-state and reversibly uncouple from each other to form a disconnected-state; and wherein said inner-volume includes a rope to retain said first-section with said second-section when in said disconnected-state.

2. The portable curling-broom of claim 1, wherein the first section includes a first-section-end with a first diameter and the second-section includes a second-section-end with a second diameter wherein the second-diameter is smaller than the first-diameter.

3. The portable curling-broom of claim 2, wherein said second-section-end inserts into said first-section-end.

4. The portable curling-broom of claim 1, further comprising a hand-grip disposed on the second-end of said handle.

5. The portable curling-broom of claim 4, wherein said hand-grip includes a plurality of ridges.

6. The portable curling-broom of claim 1, wherein said handle is approximately 5 feet long when in said connected-state.

7. The portable curling-broom of claim 6, wherein said handle is approximately 2.5 feet long when in said disconnected-state.

8. The portable curling-broom of claim 1, wherein said handle comprises light-weight material.

9. The portable curling-broom of claim 8, wherein said light-weight material comprises carbon fibers.

10. The portable curling-broom of claim 8, wherein said light-weight material comprises glass fibers.

11. The portable curling-broom of claim 1, wherein said rope comprises an elastomeric material.

12. The portable curling-broom of claim 1, wherein said rope is attached from said first-end to said second-end in said inner-volume.

13. A portable curling-broom, the portable curling-broom comprising:

a handle having a first-end, a second-end, and an inner-volume;

a curling-broom head attached to said first-end;

wherein the curling broom has an in-use state in which the handle is in a connected-state and ready for use, and a stowed state in which the handle is in a disconnected-state and not ready for use;

wherein said inner-volume includes a rope to retain said first-section with said second-section when in said disconnected-state;

wherein said second-section includes a second-section-end having a second-diameter being smaller than a first-diameter on a first-section-end of said first-section;

wherein said second-section-end is configured to be inserted into said first-section-end;

further comprising a hand-grip at said second-end of said handle; wherein said hand-grip includes a plurality of ridges;

wherein said handle is approximately 5 feet long when in said connected-state;

wherein said handle is approximately 2.5 feet long when in said disconnected-state;

wherein said second-end further includes a carrying-strap;

wherein said rope comprises an elastomeric material;

wherein said rope is attached from said first-end to said second-end in said inner-volume; and wherein said rope includes a thickness preventing splitting of said rope.

14. A method of using a portable curling-broom, the method comprising the steps of:

providing a portable curling-broom having a handle and an inner-volume including a rope, the handle comprising a first-section connected to a curling-broom head and a second-section connected to a hand-grip and removably coupled to the first section, wherein the curling broom has an in-use state in which the handle is in a connected-state and ready for use, and a stowed state in which the handle is in a disconnected-state and not ready for use;

pulling the second-section from the first-section to initiate the disconnected-state, and folding the first-section and the second-section.

15. A portable curling-broom, the portable curling-broom comprising a rope;

a handle having:

a first-end;

a second-end;

a first-section;

and a second-section removably coupled to the first-section with the rope;

and a curling-broom head attached to the first-end with a semi-pliant fastener, wherein the curling broom has an in-use state in which the handle is in a connected-state and ready for use, and the curling broom has a stowed state in which the handle is in a disconnected-state and not ready for use.

16. The curling broom of claim 15 wherein the handle is approximately 5 feet long when in the connected-state and the handle is approximately 2.5 feet long when in the disconnected-state.

17. The curling broom of claim 16 wherein the first section is directly coupled to the second section.

* * * * *